US005857867A

United States Patent [19]

Henry

[11] Patent Number: 5,857,867

[45] Date of Patent: Jan. 12, 1999

[54] HERMAPHRODITIC COAXIAL CONNECTOR

[75] Inventor: Randall R. Henry, Harrisburg, Pa.

[73] Assignee: The Whitaker Corporation, Wilmington, Del.

[21] Appl. No.: 896,188

[22] Filed: Jul. 17, 1997

[51] Int. Cl.[6] ..... H01R 13/28

[52] U.S. Cl. ..... 439/290; 439/675

[58] Field of Search ..... 439/284, 289, 439/292, 293, 294, 295, 83, 290, 291, 598, 675

[56] References Cited

U.S. PATENT DOCUMENTS

| | | | |
|---|---|---|---|
| 453,225 | 6/1891 | Wheeler | 439/284 |
| 2,690,542 | 9/1954 | Pearce et al. | 439/289 |
| 4,595,251 | 6/1986 | Moulin | 439/289 |
| 4,634,202 | 1/1987 | Taylor | 439/294 |
| 4,666,231 | 5/1987 | Sheesley et al. | 439/581 |
| 4,687,446 | 8/1987 | Birch et al. | 439/553 |
| 4,923,413 | 5/1990 | Michaels | 439/589 |
| 4,954,095 | 9/1990 | Cogan | 439/284 |
| 4,990,099 | 2/1991 | Marin et al. | 439/284 |
| 5,007,862 | 4/1991 | Defibaugh et al. | 439/607 |
| 5,030,122 | 7/1991 | Birch et al. | 439/188 |
| 5,073,123 | 12/1991 | Birch et al. | 439/188 |
| 5,108,304 | 4/1992 | Bogiel et al. | 439/290 |
| 5,125,848 | 6/1992 | Zimmerly | 439/291 |
| 5,215,470 | 6/1993 | Henry et al. | 439/63 |

OTHER PUBLICATIONS

*AMP Catalog 82212*, "Shielded Miniature Circular DIN Connectors," four pages; Jan. 1995; AMP Incorporated, Harrisburg, PA.

*Primary Examiner*—Steven L. Stephan
*Assistant Examiner*—T. C. Patel
*Attorney, Agent, or Firm*—Salvatore Anastasi; Anton P. Ness

[57] ABSTRACT

The present invention provides a hermaphroditic coaxial electrical connector (10) having an outer contact (12) formed of two halves (17, 18). The first half (17) is of a slightly smaller dimension than the second half (18). A dielectric (20) is profiled to fit within the first half (17). A signal contact (40) is disposed inside the dielectric (20) and has a contact point (42) along a mating surface (24) of the dielectric (20). Mounting feet (16) are provided on the base of the outer contact for surface mounting to a printed circuit board.

30 Claims, 2 Drawing Sheets

HERMAPHRODITIC COAXIAL CONNECTOR

FIELD OF THE INVENTION

This invention is related generally to electrical connectors and more specifically to a hermaphroditic coaxial connector.

BACKGROUND OF THE INVENTION

Coaxial connections are often required between printed circuit boards which are oriented parallel to each other. In such applications, the coaxial connector must provide simultaneous connections for a signal contact and a ground contact separated by a dielectric material. Most coaxial board to board connections require a coaxial plug on one board and a coaxial receptacle on the opposite board. This causes a problem in that the coaxial plug and the coaxial receptacle must be separately manufactured thus requiring separate tooling for each.

A known hermaphroditic electrical contact is shown in U.S. Pat. No. 5,108,304. Here Bogiel et al. teach a terminal structure having a bifurcated mating portion which is generally cylindrical and includes a pair of elongated arms. One of the arms is of a larger cross-sectional dimension than the other to provide interengagable surfaces between a pair of these terminals. While this arrangement may be effective for connecting a pair of wires in a single circuit, it is not suitable for forming a coaxial connection between a circuits having a signal conductor and an associated coaxial ground conductor.

SUMMARY

It is therefore an object of the present invention to provide a coaxial connector for connecting circuits between a pair of printed circuit boards without requiring separate tooling for a plug and a receptacle.

This and other objects have been achieved by providing a hermaphroditic coaxial electrical connector having an outer contact formed in two halves whereby one half of the outer contact is profiled to be smaller than the other half. A dielectric insert is disposed inside the outer contact such that it fills approximately one half of the outer contact. A signal contact is insertable into the dielectric such that a contact point extends from the dielectric through an opening through the outer contact remote from the mating end of the connector.

BRIEF DESCRIPTION OF THE DRAWINGS

The invention will now be described by way of example with reference to the accompanying figures of which.

DETAILED DESCRIPTION OF THE EMBODIMENT

Figure 1:
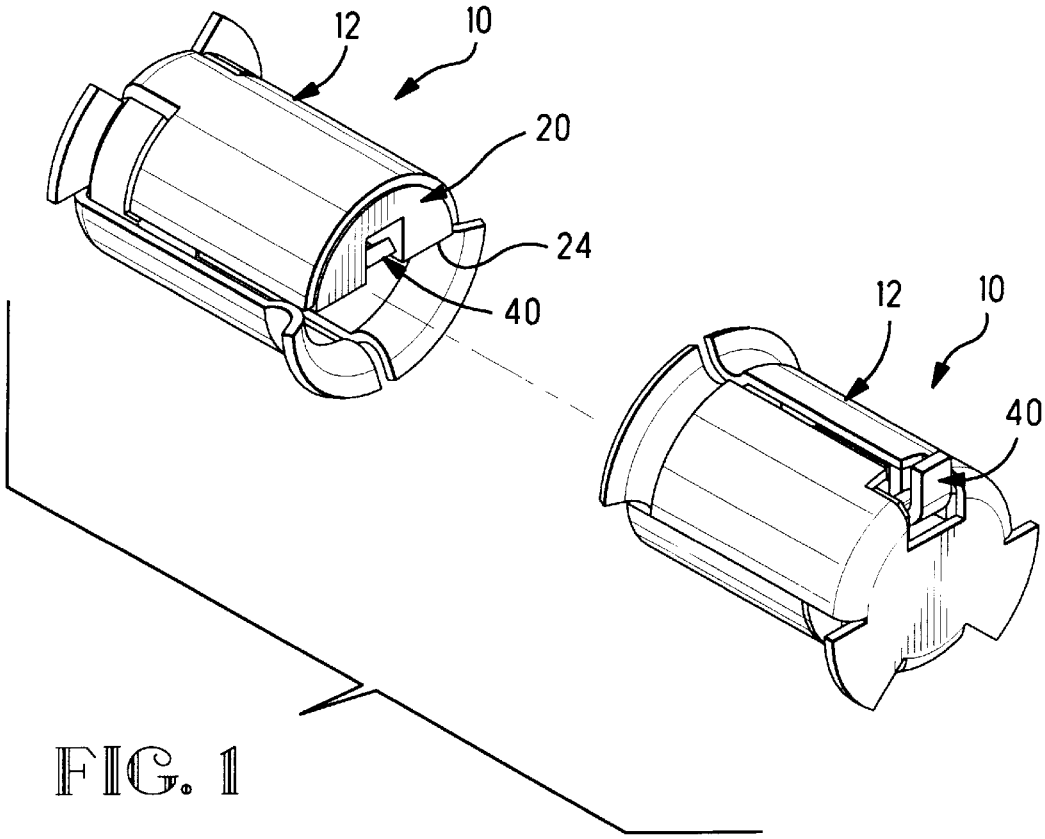
FIG. 1 shows a three dimensional view of a pair of connectors according to the present invention prior to mating.

The invention will first be described generally with reference to the embodiment of FIG. 1. The hermaphroditic electrical connector (10) consists of three major components. At a mating end of the connector, an outer contact (12) is formed in two halves such that one half is smaller than the other half. The outer contact (12) surrounds a dielectric (20) which is profiled to fit into the smaller half of the cylinder. An inner or signal contact (40) is disposed inside the dielectric and extends through a base of the outer contact (12) near a mounting end.

Figure 2:
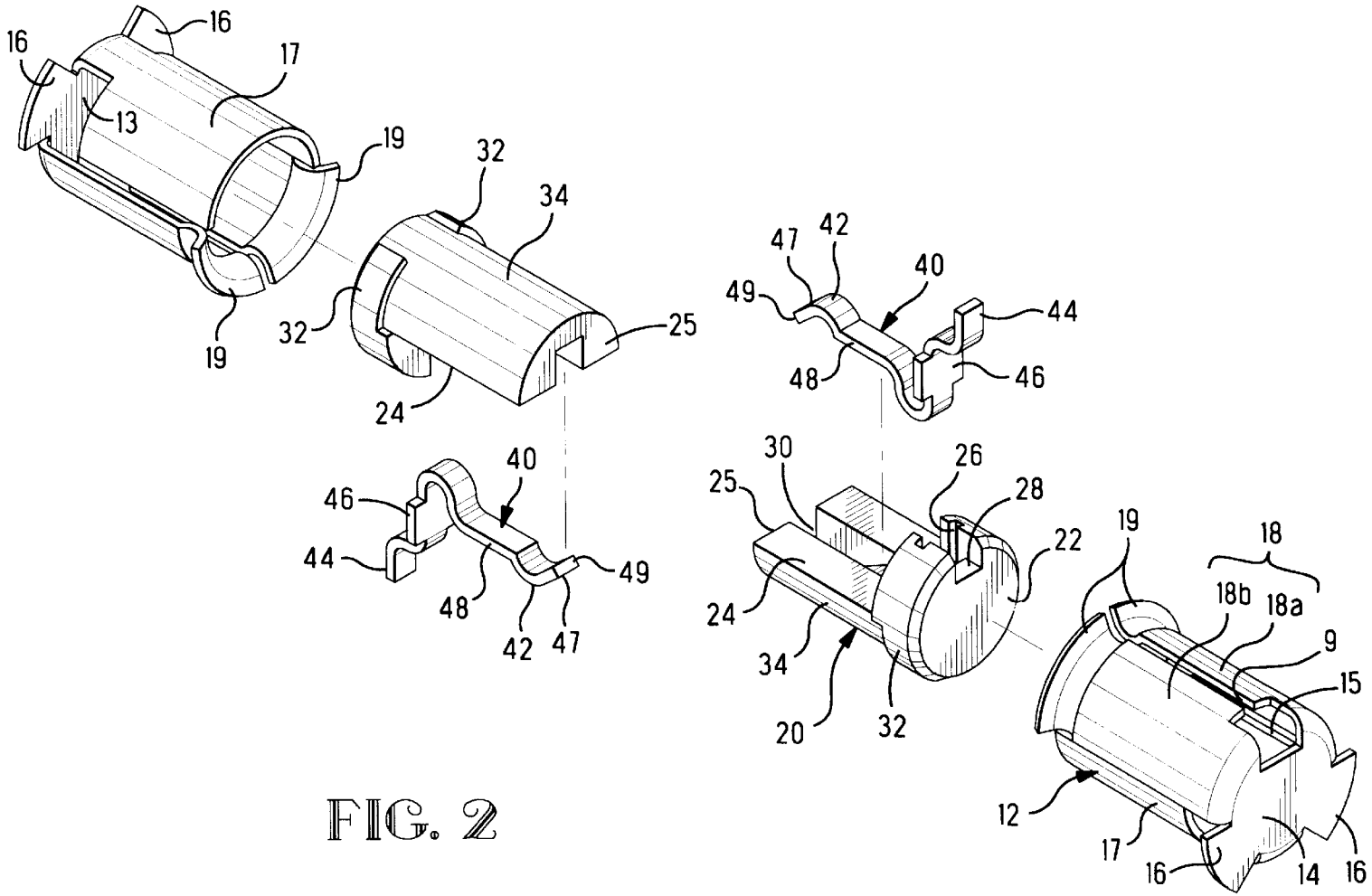
FIG. 2 shows an exploded three dimensional view of the pair of the electrical connectors of FIG. 1.

Each of the major components will now be described in greater detail with reference to FIG. 2. The outer contact (12) will be described first. It features a transverse base (14) remote from the connector mating end, the base having a pair of mounting feet (16) extending from its periphery. Two halves (17, 18) extend upward from the base to form a split cylinder contact. It should be understood that while this embodiment shows the outer contact halves as being cylindrically shaped, they may take other shapes such as oval, rectangular or any other shape as long as the first half (17) is smaller than and profiled to fit within the second half (18) the outer dimension of the first half being less than the outer dimension of the second half. The first half (17) extends up from the base (14) between two of the mounting feet (16) and has a semicircular profile which forms approximately one half of the outer contact (12). A pair of openings (13) are formed in first half (17) near each of the mounting feet (16). The second half (18) consists of two semicylinder arms **(18*a*, 18*b*) each extending upward from the base (14) opposite the first half (17). A small groove (9) extends between each of the semicylinder arms (18*a*, 18*b*). A signal contact opening (15) is formed between the semicylinder arms (18*a*, 18*b*) in communication with the groove (9) near the base (14). At an end opposite the base (14), lead in sections (19) are formed on the free ends of each semicircular arm (18*a*, 18*b*)**.

The dielectric (20) will now be described in greater detail again with reference to FIG. 2. A circular base (22) has a contact receiving slot (28) formed therein. The contact receiving slot (28) has a pair of retention grooves (26) formed along and extending between opposite sides of the slot (28). The slot (28) extends from the base (22) along a mating surface (24) to the end opposite the base (22). A pair of retaining projections (32) are formed around the periphery of the base (22). Extending from the base (22, the body (25) is formed as a solid semicylinder. The body (25) has a mating surface (24) with a slot (30) formed in its center. The slot (30) is continuous with the contact receiving slot (28). Opposite the mating surface (24), the body (25) has an outer contact engaging surface (34) which is semicircular in cross-section and profiled to engage the first half (17) of the outer contact (12).

Next, the signal contact (40) will be described in greater detail. A solder foot (44) is disposed at a first end and extends to a securing section (46) which takes the form of an enlarged flat plate profiled to fit into the retention grooves slots (26) of the dielectric (20). A cantilever arm (48) extends from the securing section (46) to a free end (49). Proximate the free end (49), a contact point (42) is formed near a lead in surface (47).

Assembly of the hermaphroditic coaxial connector (10) will now be described referring again to FIG. 2. First, the signal contact (40) is inserted into the dielectric (20) by urging the securing section (46) into the retention grooves (26). The free end (49) will then be positioned inside the slot (30) and the mounting foot (44) will exit the slot (28) near the base (22). The contact and dielectric subassembly is then inserted into the outer contact (12) such that the solder foot (44) exits the signal contact opening (15) in the base (14). It should be noted here that the dielectric (20) is secured to the outer contact (12) when the dielectric (20) is urged into the outer contact (12) such that the base (22) engages the base

(14) and the securing projections (32) are disposed inside the openings (13). This completes the assembly of the hermaphroditic coaxial connector (10).

Figure 3:
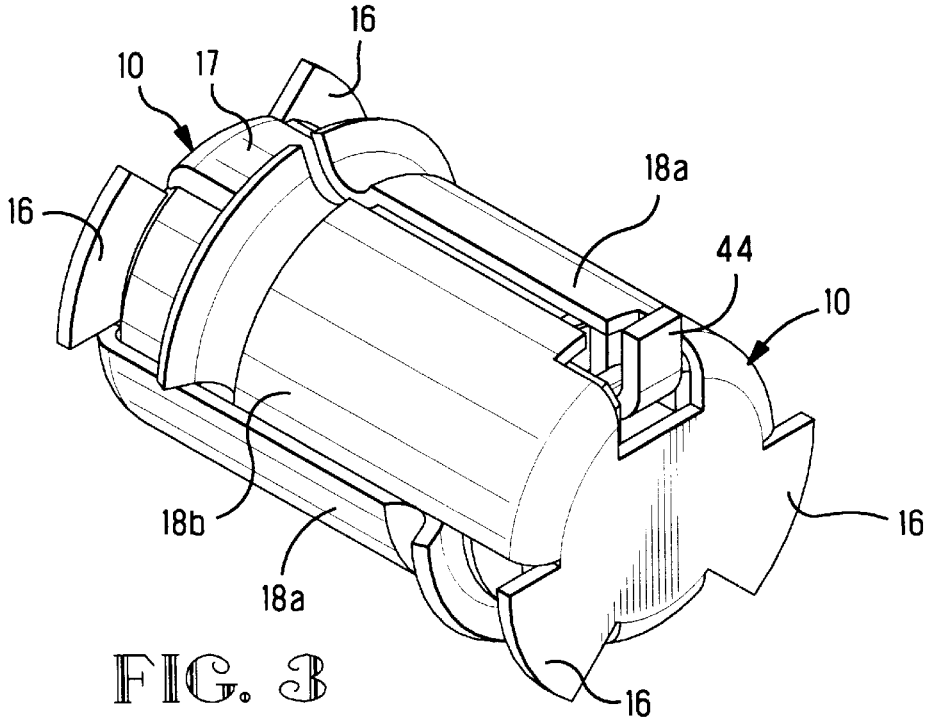
FIG. 3 shows a three dimensional view of the connectors of FIG. 1 in a mated condition.

Mating of a pair of these hermaphroditic coaxial connectors (10) will now be described with reference to FIGS. 1 and 3. FIG. 1 shows a pair of the connectors (10) in an unmated condition and FIG. 3 shows these connectors (10) in a mated condition. Referring first to FIG. 1, it can be seen that each of the mating surfaces (24) of the dielectrics (20) are positioned to engage each other and each of the outer contact first halves (17) are positioned to be inserted inside each of the outer contact second halves (18). The connectors (10) are urged together such that the first outer contact half (17) of one connector (10) engages the lead in surface (19) of the outer contact second half (18) of the other connector (10). The connectors (10) are then urged further together as shown in FIG. 3 such that the contact points (42) of each of the signal contacts (40) engage each other, the mating surfaces (24) of the dielectrics engage each other, and the outer contact first half (17) of one connector (10) engages the outer contact second half (18) of the other connector (10). This completes mating of the electrical connectors (10).

The advantage of the present invention is that a singular set of tooling may be utilized to create a pair of mating electrical coaxial connectors (10) thus reducing the manufacturing cost of these connectors.

I claim:

1. A coaxial hermaphroditic electrical connector comprising:

an outer contact being formed in two halves each extending from a base, the first of the two halves having an outer dimension less than an outer dimension of the second of the two halves, a dielectric being disposed substantially inside one of the outer contact halves, the dielectric having a base which is securable to the outer contact, a mating surface extending from the base along the one outer contact half and a contact receiving groove formed in the mating surface; and a signal contact disposed inside the contact receiving groove and extending beyond the mating surface to be engageable with a duplicate signal contact of a mating connector.

2. The electrical connector according to claim 1 wherein the outer contact is a split cylinder.

3. The electrical connector according to claim 2 wherein the first half is a semicylinder, the second half is a semicylinder and the first half semicylinder has an outer diameter which is dimensioned to be incrementally larger than an inner diameter of the second half semicylinder.

4. The electrical connector according to claim 3 wherein the second semicylinder half has a lead in surface disposed at a free end.

5. The electrical connector according to claim 3 wherein the second semicylinder half is formed of two resilient arms which are attached to the base.

6. The electrical connector according to claim 1 wherein the dielectric mating surface is oriented to be perpendicular to the dielectric base.

7. The electrical connector according to claim 1 wherein the dielectric further comprises a securing slot extending from opposite sides of the contact receiving groove.

8. The electrical connector according to claim 1 wherein the signal contact is profiled to have a solder foot at a first end.

9. The electrical connector according to claim 8 wherein the signal contact further comprises a securing section extending from the solder foot and being profiled to be received and secured into a securing slot formed in the dielectric.

10. The electrical connector according to claim 9 wherein the signal contact further comprises a cantilever arm extending from the securing to a free end.

11. A hermaphroditic electrical connector having a first contact which is split into first and second semicylindrical halves, the first half having an outer radius less than an inner radius of the second half of a duplicate mating connector, the hermaphroditic electrical connector being characterized by:

a dielectric disposed inside one of the first contact halves and having a mating surface which extends from a base toward a free end, a contact receiving groove disposed inside the mating surface, and a securing slot extending through the contact receiving groove near the base; and a signal contact being disposed inside the contact receiving groove and having a contact point near a free end which extends from the contact receiving groove beyond the mating surface, whereby the signal contact and the first contact are positioned in a coaxial arrangement relative to each other.

12. A coaxial connector having an outer contact, an inner contact and a dielectric disposed therebetween the connector comprising:

two outer contact halves which form the outer contact, one contact half having an outer dimension less than an outer dimension of the other contact half, whereby the one contact half of one connector is adapted to fit inside the other contact half of the other connector, and the one contact half of one connector adapted to engage the other contact half of the other connector; and a dielectric mating surface which is formed in the dielectric along a plane which extends between the outer contact halves.

13. The electrical connector according to claim 12 wherein the outer contact halves form a split cylinder.

14. The electrical connector according to claim 13 wherein the first half is a semicylinder, the second half is a semicylinder and the first half semicylinder has an outer diameter which is dimensioned to be incrementally larger than an inner diameter of the second half semicylinder.

15. The electrical connector according to claim 14 wherein the second semicylinder half has a lead in surface disposed at a free end.

16. The electrical connector according to claim 15 wherein the second semicylinder half is formed of two resilient arms which are attached to a base.

17. The electrical connector according to claim 12 wherein the dielectric mating surface is oriented to be perpendicular to a dielectric base which is securable inside the outer contact.

18. The electrical connector according to claim 12 wherein the dielectric further comprises a contact receiving groove formed in and extending along the mating surface.

19. The electrical connector according to claim 18 wherein the dielectric further comprises a securing slot extending from opposite sides of the contact receiving groove.

20. The electrical connector according to claim 12 wherein the inner contact is profiled to have a solder foot at a first end.

21. The electrical connector according to claim 20 wherein the inner contact further comprises a securing section extending from the solder foot and being profiled to be received and secured into a securing slot formed in the dielectric.

22. The electrical connector according to claim 21 wherein the inner contact further comprises a cantilever arm extending from the securing section to a free end and a contact point disposed along the cantilever arm proximate the free end.

23. The electrical connector according to claim 20 wherein the outer contact base is transverse with respect to the outer contact halves, is planar to define a board-mounting surface, and the inner contact solder foot is coplanar therewith.

24. The electrical connector according to claim 20 wherein the outer contact base includes an opening permitting the inner contact solder foot to extend therethrough spaced and isolated from the outer contact base.

25. The electrical connector according to claim 8 wherein the outer contact base is transverse with respect to the outer contact halves, is planar to define a board-mounting surface, and the signal contact solder foot is coplanar therewith.

26. The electrical connector according to claim 8 wherein the outer contact base includes an opening permitting the signal contact solder foot to extend therethrough spaced and isolated from the outer contact base.

27. The electrical connector according to claim 11 wherein the outer contact base is transverse with respect to the outer contact halves, is planar to define a board-mounting surface, and the signal contact solder foot is coplanar therewith.

28. The electrical connector according to claim 11 wherein the outer contact base includes an opening permitting the signal contact solder foot to extend therethrough spaced and isolated from the outer contact base.

29. A electrical connector assembly of a pair of hermaphroditic connectors each having a first contact which is split into first and second semicylindrical halves, the first half having an outer radius less than an inner radius of the second half of a duplicate mating connector, the hermaphroditic electrical connector being characterized by:

a dielectric disposed inside one of the first contact halves and having a mating surface which extends from a base toward a free end, a contact receiving groove disposed inside the mating surface, and a securing slot extending through the contact receiving groove near the base; and a signal contact being disposed inside the contact receiving groove and having a contact point near a free end which extends from the contact receiving groove beyond the mating surface, whereby the signal contact and the first contact are positioned in a coaxial arrangement relative to each other.

30. The electrical connector according to claim 29 wherein the outer contact base is transverse with respect to the outer contact halves, is planar to define a board-mounting surface, a first end of the inner contact includes a solder foot coplanar with the base, and the outer contact base includes an opening permitting the inner contact solder foot to extend therethrough spaced and isolated from the outer contact base.

* * * * *